United States Patent [19]

Kempf

[11] 4,345,758

[45] Aug. 24, 1982

[54] CONVERTIBLE TABLE, ESPECIALLY FOR GAMES

[76] Inventor: Bertrand Kempf, 46, rue des Martyrs, 75009 Paris, France

[21] Appl. No.: 123,189

[22] Filed: Feb. 20, 1980

[30] Foreign Application Priority Data

Mar. 1, 1979 [FR] France ..... 79 05352

[51] Int. Cl.[3] ..... A63B 61/00

[52] U.S. Cl. ..... 273/30; 108/33; 108/50; 108/63; 108/96

[58] Field of Search ..... 108/1.7, 63, 70, 83, 108/73, 93, 95, 96; 273/30

[56] References Cited

U.S. PATENT DOCUMENTS

| | | | |
|---|---|---|---|
| 499,674 | 6/1893 | Grossman | 108/93 |
| 1,049,668 | 1/1913 | Carlson et al. | 108/96 |
| 1,086,941 | 2/1914 | Sarkoze | 108/70 |
| 1,667,665 | 4/1928 | Klingersmith | 108/63 |
| 1,703,187 | 2/1929 | Buck | 108/63 |
| 1,756,586 | 4/1930 | Drew | 108/73 |
| 1,817,186 | 8/1931 | Graff | 108/95 |
| 2,613,789 | 10/1952 | McLaughlin | 108/93 |
| 2,869,956 | 1/1959 | Gaines | 108/73 |

FOREIGN PATENT DOCUMENTS

| | | | |
|---|---|---|---|
| 380845 | 1/1932 | Fed. Rep. of Germany | 108/93 |

*Primary Examiner*—Richard C. Pinkham
*Assistant Examiner*—T. Brown
*Attorney, Agent, or Firm*—Young & Thompson

[57] ABSTRACT

A convertible table which is primarily intended for games comprises a stationary horizontal bottom panel and a movable panel slidably mounted for outward withdrawal or inward return to the storage position by means of at least one pair of roller-tracks carried by fixed side-panels. The roller-tracks are placed with respect to the stationary bottom panel at a level such that the two panels are located in the storage position at a vertical distance from each other which permits storage of objects on the bottom panel.

11 Claims, 11 Drawing Figures

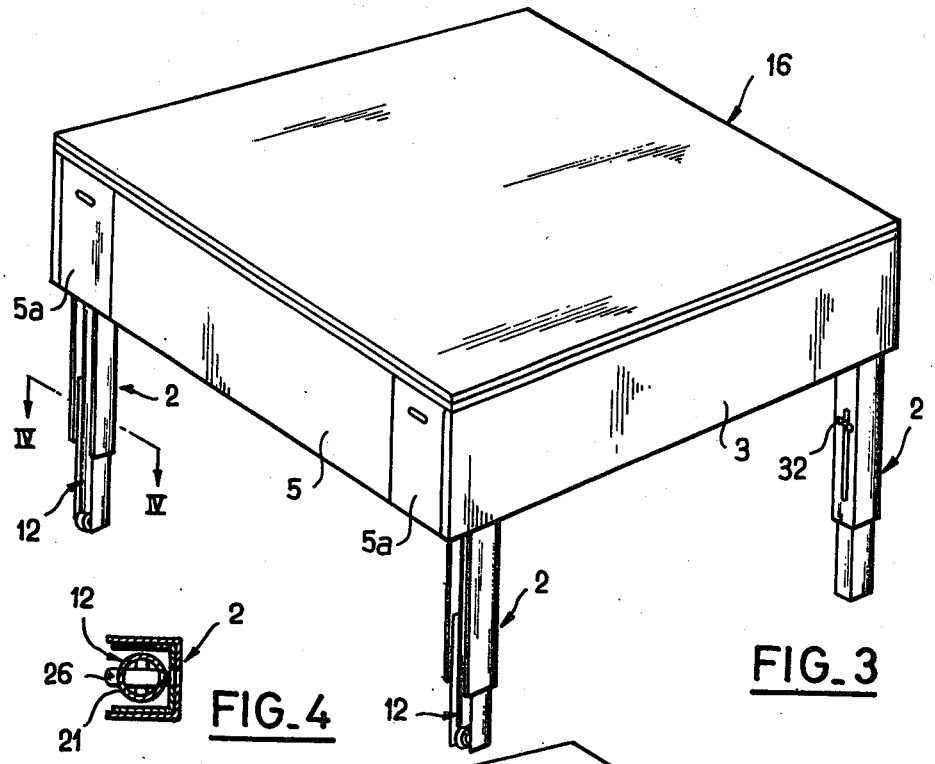
FIG_3
FIG_4
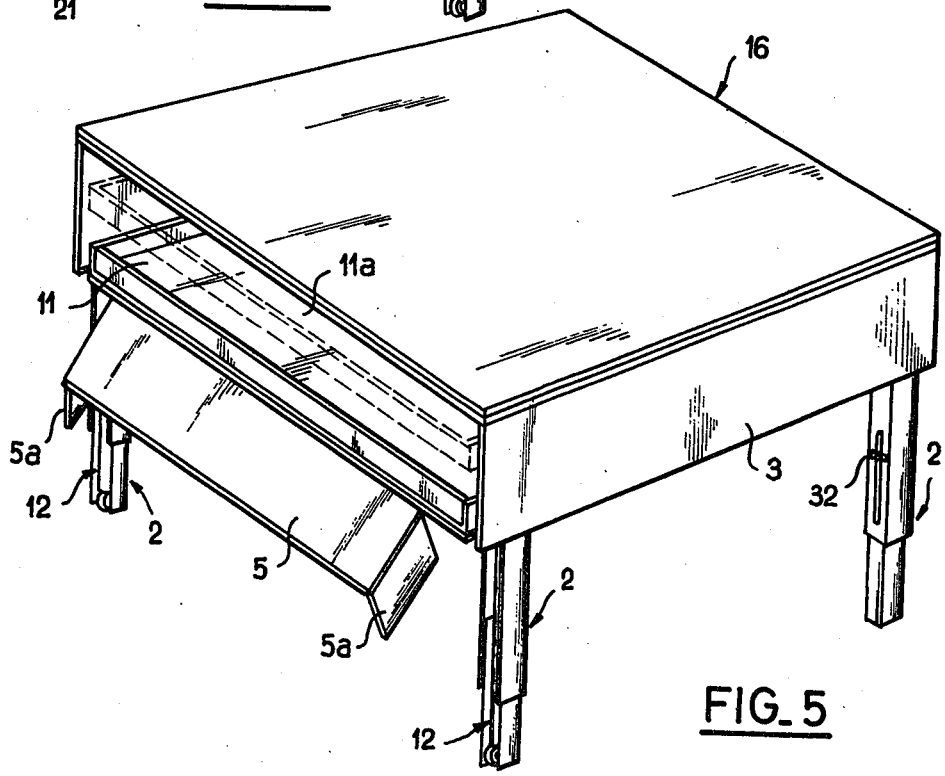
FIG_5

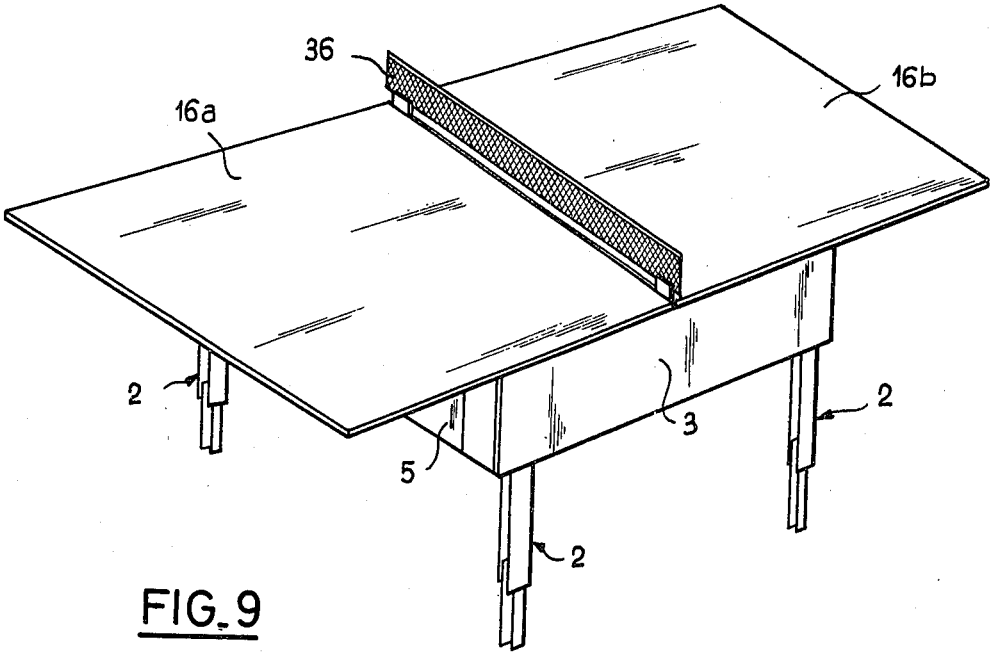
FIG. 9
FIG. 11
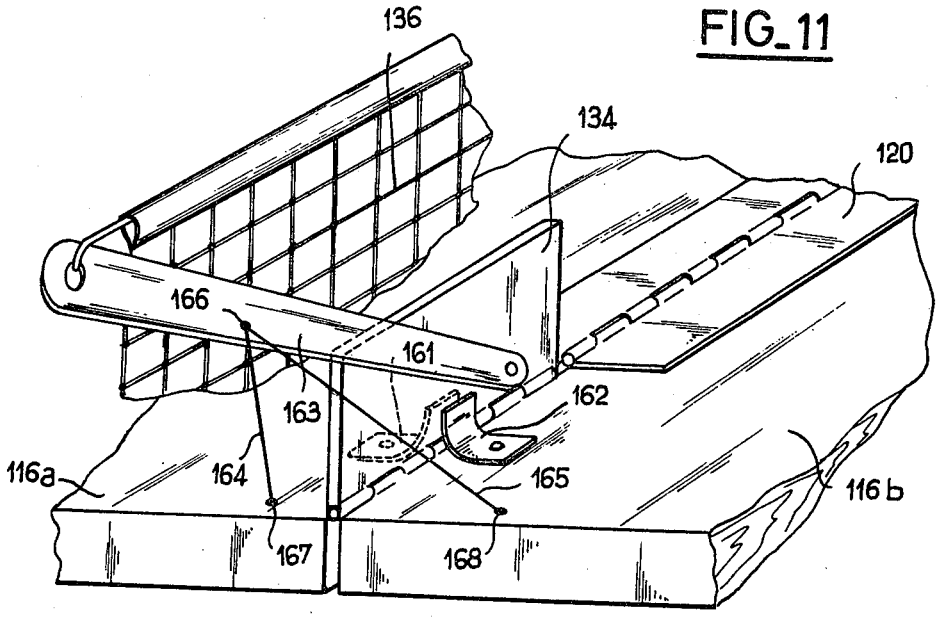

CONVERTIBLE TABLE, ESPECIALLY FOR GAMES

This invention relates to a convertible table which can be employed in particular for certain games requiring large surfaces such as an electric train with a complex railroad network, or table tennis.

Many known types of adaptable or convertible tables provide a large surface area which can be considerably reduced for storage purposes.

For putting them into service as well as for storage, folding tables call for relatively time-consuming operations which are sometimes arduous when the tables are of large size. Another known type of table consists of panels which are adapted to slide with respect to each other and are superposed in the rest position but abuttingly placed in end-to-end relation in order to obtain a large surface. In general, these tables are easier to handle but suffer from the same disadvantage as the others inasmuch as they have to be completely cleared before being put away in the folded state. The need for such an operation is regrettable, however, when a game has finally been installed only after considerable time and meticulous care as is the case, for example, with a complex electric train and railroad system. Furthermore, folding tables of known types usually lend themselves only to a limited number of uses.

The aim of the present invention is to provide a convertible table which overcomes the disadvantages mentioned in the foregoing. In particular, the table can be put away in the folded state without entailing the need to clear the table beforehand.

According to the invention, the convertible table which is primarily intended for games comprises a stationary horizontal bottom panel mounted on four rigid legs and a movable panel slidably mounted for displacement in a direction parallel to said stationary panel by means of rollers adapted to cooperate with at least one pair of roller tracks.

The movable panel can be positioned in the line of extension of the stationary bottom panel and is provided with at least one leg fitted with a small wheel for supporting said movable panel in the outwardly withdrawn position. The convertible table essentially comprises one pair of roller tracks carried by side-panels fixed on the stationary bottom panel. Said roller tracks are placed with respect to the stationary bottom panel at a level such that the two panels are located in the storage position at a vertical distance from each other which permits storage of objects on said stationary bottom panel.

When it is desired to put the table in the storage position, it is accordingly unnecessary to clear the surface of the stationary bottom panel even when it is completely occupied by a large number of objects.

Preferably, the table comprises movable ramps for selectively engaging the rollers of the movable panel on either of the two pairs of roller tracks.

In an advantageous embodiment of the invention, the legs of the movable panel are telescopic and are each fitted with a spring which tends to cause extension of said legs.

When the movable panel is outwardly withdrawn, said panel tends to swing downwards to an oblique position with respect to the horizontal, the angle of slope being of progressively decreasing value as the panel reaches the end of its movement of outward withdrawal. As it is being withdrawn, however, the panel is applied with progressively greater force on its telescopic legs, thus having the effect of reducing the length of the legs and tending to maintain the movable panel in a horizontal position throughout the operation. The same result is achieved during the storage operation.

Each leg of the movable panel comprises a system for locking the leg in a position corresponding to a predetermined length in order to suppress the elasticity of the legs once the above-mentioned operations have been completed.

In another advantageous embodiment of the invention, the side-panels each carry two roller guide rails adapted to cooperate with the rollers of the movable panel in order to ensure that the movement of inward withdrawal of the movable panel has the effect of lifting the stationary bottom panel and that the table rests to a partial extent on the legs of the movable panel in the inwardly withdrawn position of this latter.

By reason of the fact that the legs of the movable panel are fitted with small wheels, the table can then be readily displaced in the folded state simply by lifting the side opposite to the wheeled legs.

In order to make use of this property in both positions of storage of the movable panel, the system for locking the movable-panel legs is provided with two locking positions corresponding respectively to the two levels of storage of said movable panel.

In a preferred embodiment of the invention, the table comprises a cover which serves as a table-top and rests on the side-panels. Said cover is capable of longitudinal sliding motion and is provided in the central portion thereof with a hook for fastening it on the stationary end-panel in the open position.

Once the sliding motion of the cover has been completed over a distance corresponding to approximately one-half the length of said cover, the fastening hook is brought to bear on the stationary end panel and makes it possible to swing the cover to a vertical back-board position at the end of the table.

The cover is advantageously constituted by two superposed table-top panels joined together by means of a transverse hinge placed on the edge corresponding to that side of the table from which the movable panel is outwardly withdrawn. Provision is also made for displaceable spacer members which serve to extend the legs of the movable panel and to receive the unfolded tabletop panel when said movable panel is in the outwardly withdrawn position.

The unfolded cover then rests on the vertical side-panels and end-panels which surround the stationary bottom panel and on the spacer members. The cover thus constitutes an opened-out table-top on which a game of table tennis can be played.

The legs of the movable panel are then preferably fitted with springs for receiving the spacer members. Thus by exerting a suitable pressure on the table, this half of the cover can be downwardly inclined to a sufficient extent to cause a ping-pong ball which has come to a standstill at the center of the table to roll back to the player.

In an improved embodiment of the invention, the hinge-pin is adapted to carry in the vicinity of each end portion thereof an articulated plate fitted with means for fixing a table-tennis net. Springs attached to the table are provided for maintaining said plates in an upright position when the two table-top panels which form the cover are opened-out horizontally.

The table-tennis net does not need to be removed for storage. It remains permanently fixed on the table and held between the two folded-back halves of the cover. When said cover is opened-out, the net is automatically restored to the vertical position by means of the springs.

Preferably, a resilient L-shaped strip is slidably mounted within each articulated plate in order to secure the ends of the net, said resilient strips being so arranged as to project outwards from the table.

This outward projection corresponds to an arrangement prescribed by table-tennis regulations. The sliding strips can readily be withdrawn at the moment of storage.

To this end, the resilient strips are advantageously connected together by elastic means which tend to draw said strips towards each other and are maintained in position by means of retractable shouldered portions applied against the articulated plates.

In an alternative embodiment, the plate is adapted to carry a lever pivotally mounted on said plate, the free end of said lever being intended to project outwards from the table and to carry an upper end of the net. Said lever is connected by means of two cables to two points of attachment arranged respectively on the table and symmetrically with respect to the hinge.

Further properties and advantages of the invention will become apparent from the following detailed description, reference being made to the accompanying drawings which are given by way of example and not in any limiting sense, and wherein:

FIG. 3 is a view in perspective showing the table in the storage position;

FIG. 4 is a sectional view of the table leg, this view being taken along line IV—IV of FIG. 3;

FIG. 5 is a view in perspective showing the table in the open position in readiness for outward withdrawal of the movable panel;

FIG. 9 is a view which is similar to FIG. 8 and shows another mode of utilization of the table;

FIG. 11 is a view which is similar to FIG. 10 in an alternative embodiment.

Figure 1:
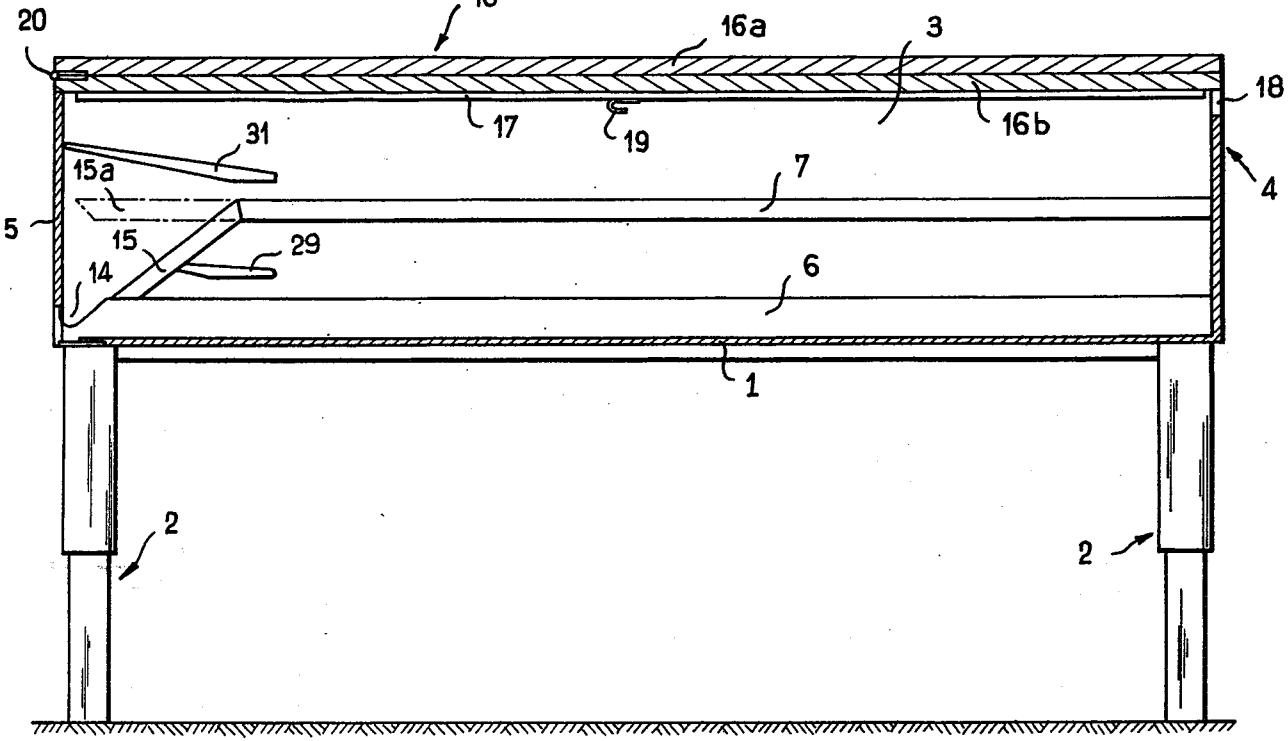
FIG. 1 is a longitudinal sectional view of a table according to the invention in which it is assumed that the movable panel has been removed.

Referring to FIG. 1, the table comprises a stationary bottom panel 1 supported by four table legs 2 and surrounded by two side panels 3, a stationary end panel 4 and a downwardly-folding end panel 5.

Figures 2, 10:
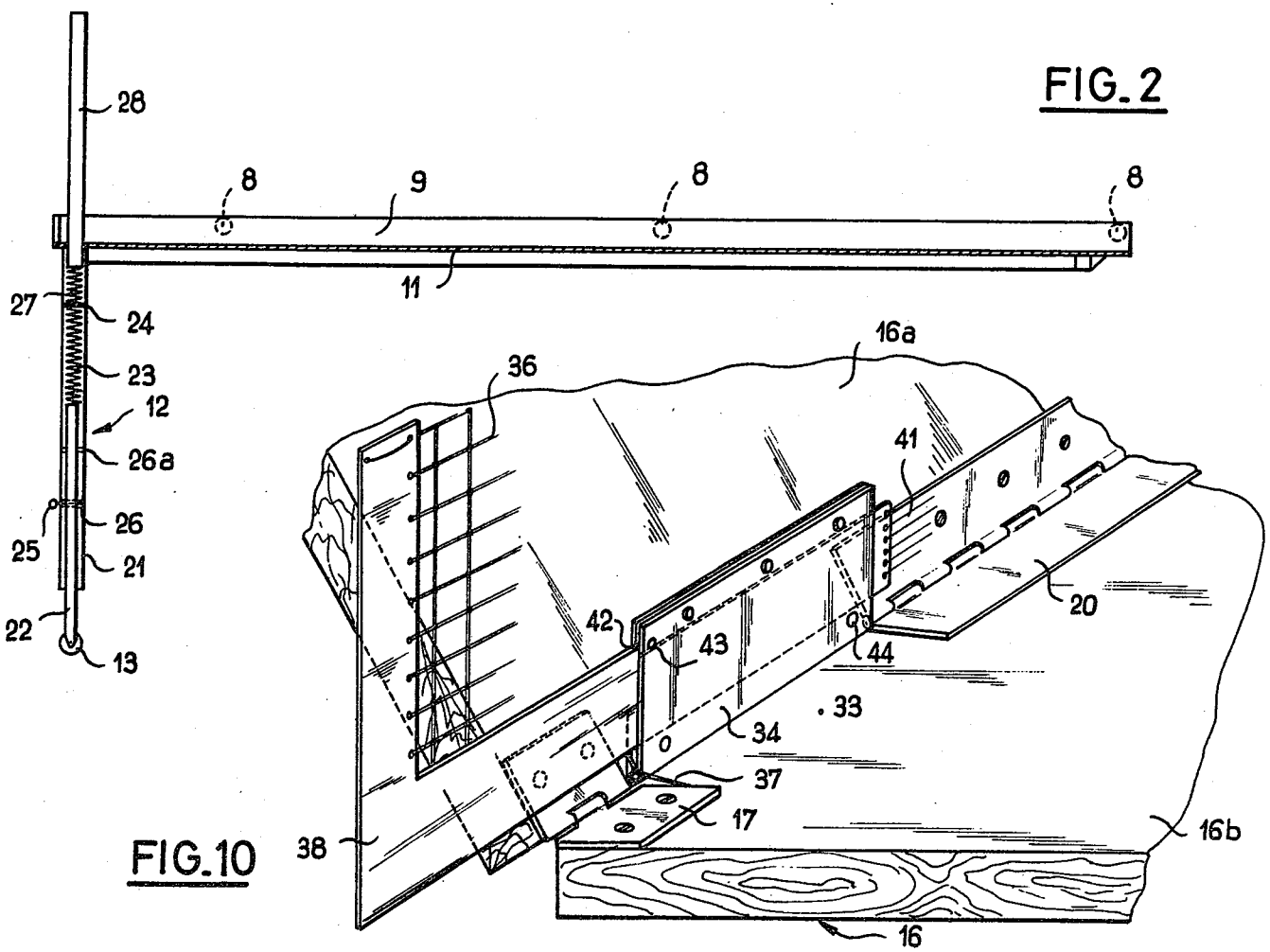
FIG. 2 is a longitudinal sectional view of the movable panel and of the table leg.
FIG. 10 is a detail view in perspective showing the articulation of the two half-portions of the cover.

Two pairs of roller tracks 6 and 7 are fixed at different levels on the side-panels 3 and adapted to carry rollers 8 (as shown in FIG. 2). Said rollers are fixed on lateral side-members 9 of a movable panel 11 fitted with two telescopic legs 12 each provided at the lower end with a small wheel 13.

The dimensions of the movable panel 11 are such that this latter can be completely introduced within the casing formed by the stationary bottom panel 1, the endpanels and the side-panels in order that the telescopic legs 12 may engage within two of the table legs 2 which accordingly consist of U-section or channel members (as shown in FIGS. 3 and 4).

In the position of outward withdrawal of the movable panel 11 (shown in FIG. 7), one end of said panel rests on its telescopic legs 12 and the other end is supported by its end rollers in a notch 14 (shown in FIG. 1) formed in the roller track 6.

In the storage position considered earlier, the rollers 8 rest on one of the roller tracks 6 or 7. Starting from its outwardly withdrawn position, the movable panel can be returned to the storage position either on the roller track 6 or on the roller track 7, depending on the position 15 or **15*a* of a movable ramp 15 (as shown in FIG. 1**).

A cover 16 is constituted by two superposed table-top panels **16*a* and 16*b* which are pivotally coupled together by means of a hinge 20 (as shown in FIG. 1). Said cover rests freely on the vertical side-panels and end-panels which surround the stationary bottom panel 1 and can thus be displaced in longitudinal sliding motion while being guided between the side-panels 3 by two lateral battens 17 which are capable of displacement within recesses 18 formed in the stationary end-panel 4**.

Figure 6:
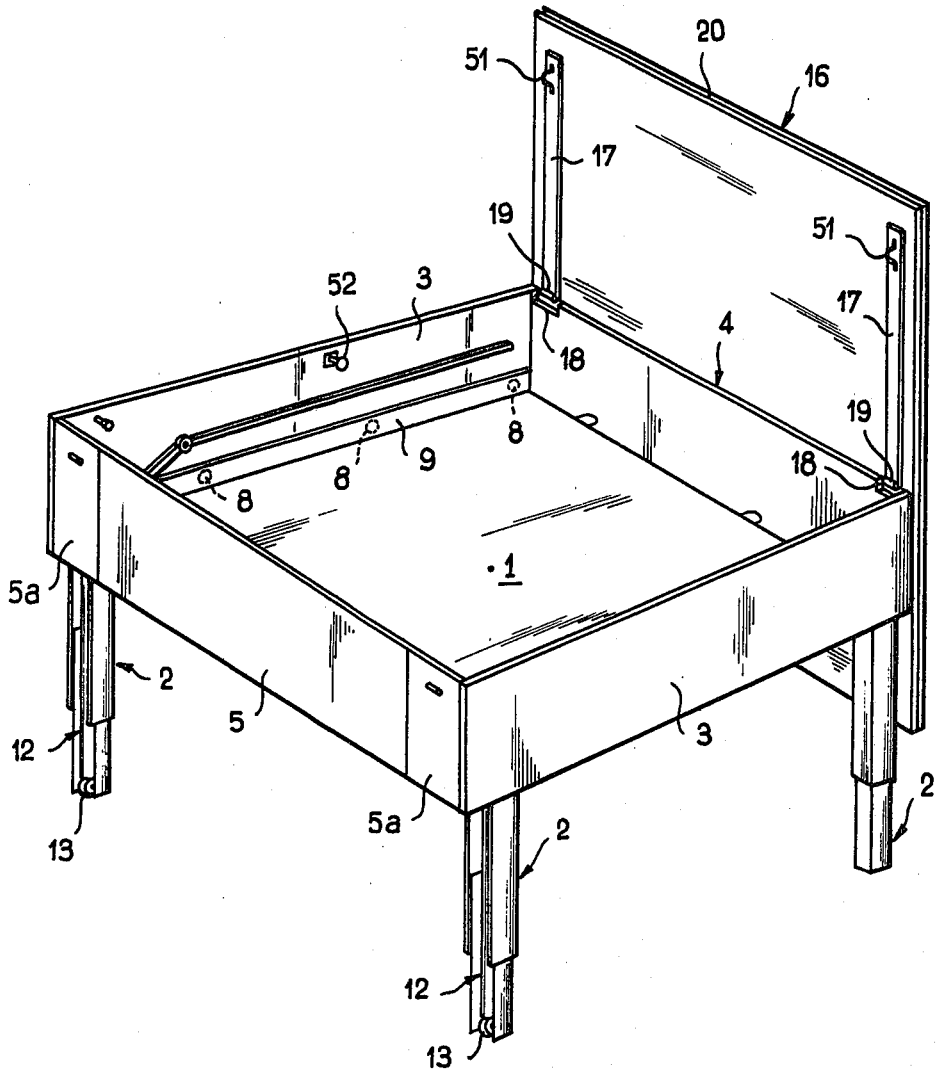
FIG. 6 is a view in perspective showing the table with the cover in the open position.
Figure 7:
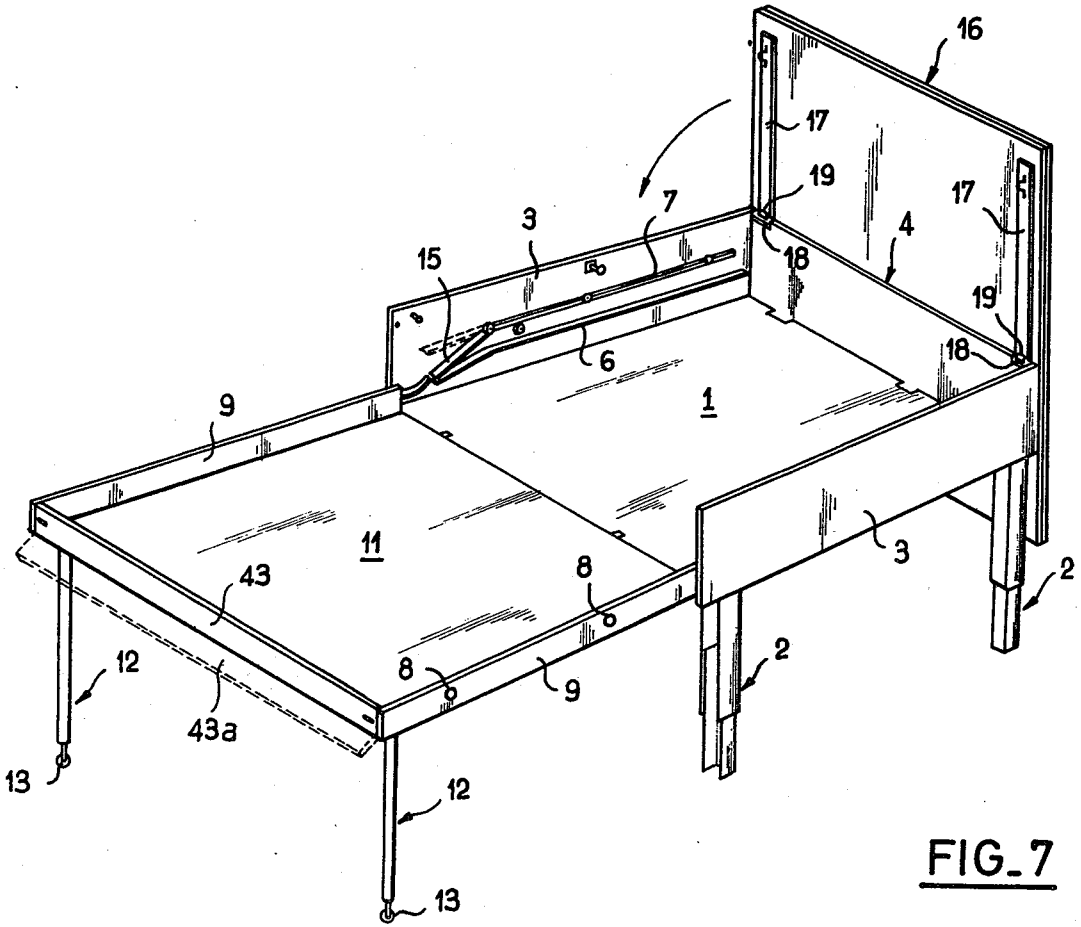
FIG. 7 is a view in perspective showing the table in the position of outward withdrawal of the movable panel.

Each batten 17 is adapted to carry a hook 19 which, when the cover has been displaced substantially over a distance corresponding to one-half the length of the table, is brought to bear on the corresponding recess 18 in order to permit pivotal displacement of the cover to the vertical back-board position (as shown in FIGS. 6 and 7).

In addition, each batten 17 is provided with a staple 51 at the end nearest the hinge 20. Said staple is adapted to engage within a spring-loaded hook 52 which is fixed on the side-panel 3 substantially at the center of said panel.

The telescopic leg 12 of the movable panel 11 (as shown in FIGS. 2 and 4) comprises a tube 21 rigidly fixed to said panel, a rod 22 which carries the small wheel 13 being slidably mounted within said tube. A spring 23 applied against a stop 24 which is attached to the tube 21 tends to thrust the rod 22 downwards and thus to cause extension of the telescopic leg 12. A removable locking-pin 25 adapted to traverse the rod 22 and the tube 21 through holes 26 makes it possible to secure the leg 12 in a fixed position corresponding to a predetermined length of said leg. Another set of holes **26*a* in the tube 21 defines another fixed position corresponding to a different length of the leg 12**.

Figure 8:
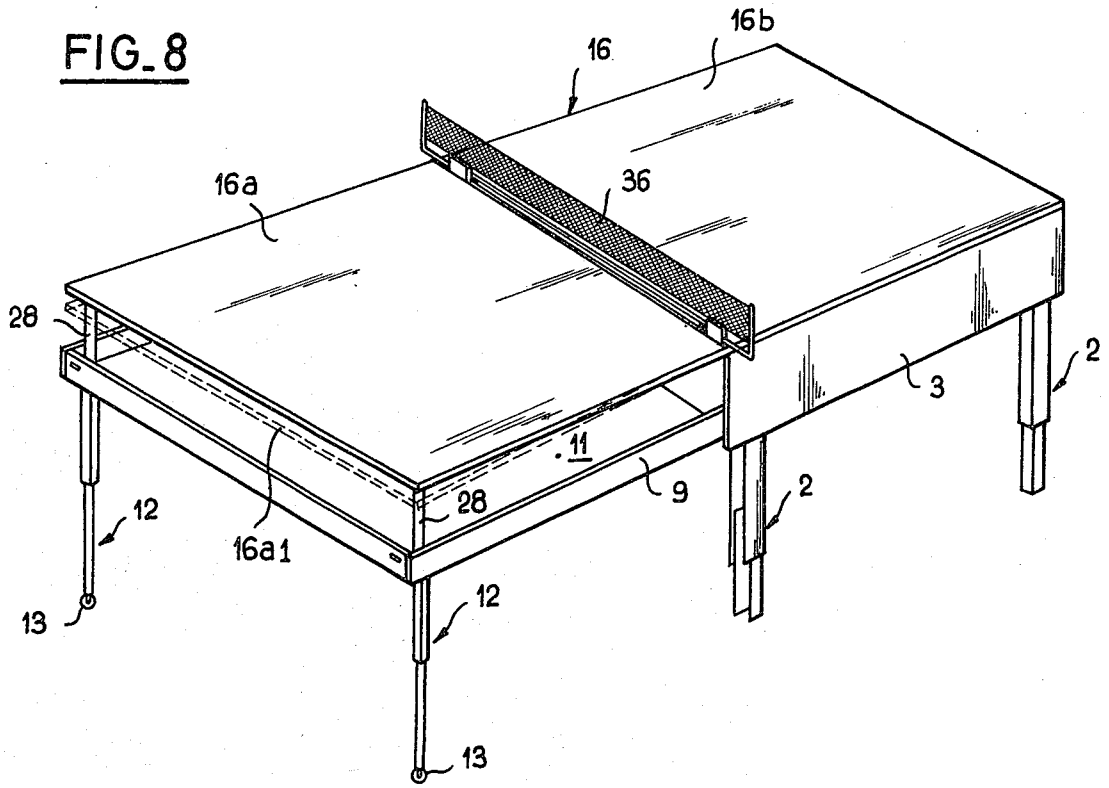
FIG. 8 is a view in perspective showing the table in the position of outward withdrawal of the movable panel with the cover in the opened-out position for table tennis.

Another spring 27 applied against the other side of the stop 24 serves as a resilient support for a displaceable spacer member 28. The length of the spacer member 28 is such that, once the cover 16 has been opened-out by means of the hinge 17 and bears on said spacer member, said cover forms a practically flat and horizontal surface (as shown in FIG. 8).

The panels 3 on each side of the stationary bottom panel 1 are each adapted to carry two roller guide rails 21, 31 located respectively above the roller tracks 6 and 7 in order to cooperate with the rollers 8 in the event that the length of the telescopic legs 12 has been fixed at a value which is slightly greater than the length of the table legs 2.

It should further be noted that the table legs 2 are also telescopic and that the length of these latter can be adjusted by means of a guide slot 32 (as shown in FIGS. 3 and 5) according to the height of persons using the table.

In the vicinity of each end, the hinge 20 is provided with an interrupted portion 33 (as shown in FIG. 10) in order to leave room for a plate 34 formed by a sheet-metal member which is folded-back against itself and pivotally mounted on the hinge-pin. A spring 37 keyed on the hinge-pin makes it possible to rotate the plate 34 in order to place this latter at right angles to the cover 16.

A resilient L-shaped strip 38 is inserted within the plate 34 while remaining capable of displacement in free sliding motion, the free arm of said strip being adapted to carry the end of a net 36. The strip 38 is formed of material which is sufficiently resilient to yield if it is struck by any person but is also sufficiently rigid to retain its shape when not subjected to any applied force.

The strip 38 passes right through the plate 34 and is connected by means of elastic ties 41 to a similar strip located at the other end of the hinge. A stepped or shouldered portion 42 of the strip 38 forms a retractable stop which bears on a spacing-pin 43 of the plate 34. Said stop prevents the strip 38 from being drawn towards the other strip by the ties 41 and maintains the strip in the position shown, namely in which it projects outwards from the table.

The resilient strip 38 is applied at the other end against another spacing-pin 44 of the plate 34, with the result that it is only necessary to lower the outwardly-projecting portion of the strip 38 in order to release the shouldered portion 42 from the spacing-pin 43. The shouldered portion 42 is applied against the plate 34 by virtue of the fact that the table-tennis net is provided with an elastic top band which exerts higher tension than the ties 41.

The mode of utilization of the table will now be described.

After removal of the wrapper, the table is permanently fitted with the legs 2 of the stationary bottom panel and thus has the appearance shown in FIG. 3.

By opening the downwardly-folding end-panel 5 provided with two movable side-flaps 5*a*, access can be gained to the movable panel 11.

The movable panel 11 can then be withdrawn outwards while the rollers 8 run along the roller track 6. The cantilevered or overhung portion of said movable panel rests on the telescopic legs 12. The inclination which would tend to take place at the beginning of the movement of outward travel is compensated by the springs 23 which are required to support only a small fraction of the weight of the panel during this stage of outward travel. When the panel has nearly reached the end of its travel, the weight carried is greater and the telescopic legs 12 are subjected to a resilient movement of compression. During its entire outward travel, the panel 11 is therefore maintained as horizontal as possible.

On completion of the movement of outward withdrawal, the last roller 8 engages within the notch 14 of the roller track 6.

When the cover 16 has also been swung back as indicated earlier, the table then has the appearance shown in FIG. 7. The table can accordingly be employed for various games which call for an installation on a flat surface such as a model electric train and railroad system, for example.

In the example shown in FIG. 7, the movable panel comprises a transverse side-member 43 which is hinged to swing downwards at 43*a* and thus provides a flat surface which is completely surrounded by a raised edge.

After use, the storage operation consists in carrying out reverse movements in order to return to the position of FIG. 2, this being achieved by placing the movable ramp 15 in position 15*a* (as shown in FIG. 1) in order to ensure that the rollers 8 engage on the roller track 6.

This storage operation, however, makes it necessary to remove all objects placed on the stationary bottom panel 1. Should it be desired to keep such objects in position, for example in the case of a game such as an electric train which has taken a long time to install, it is only necessary to put the ramp 15 in the bottom position in order to switch the rollers 8 onto the roller track 7. This accordingly places the movable panel in the top position 11*a* (shown in FIG. 5) and frees an appreciable space above the stationary bottom panel 1.

Towards the end of the storage operation, the locking-pins 25 can be placed in the holes 22 or 22*a* corresponding to the selected storage position. The precise location of said holes is such that the telescopic legs 12 are then slightly longer than the table legs 2. At the end of the storage operation, the rollers 8 are consequently applied against the guide rails (29 or 31 as the case may be) in order to cause a slight upward displacement of the table by lifting the table legs 2 in which the telescopic legs 12 are inserted, this operation being performed by opening the side-flaps 5*a*. The table then rests on the ground by means of two fixed legs 2 and two legs fitted with rollers 13, thus facilitating its displacements.

The table can also be employed without outwardly withdrawing the movable panel (as shown in FIG. 6) while the end-panel 5 remains in the closed position, in which case the table can serve as a play-pen for a very small child.

In the outwardly-withdrawn position, the spacer members 28 can be placed in position and the table-top panels 16*a* and 16*b* which constitute the cover 16 can be opened-out over the table unit so that the panel 16*a* bears on the spacer members. A table-tennis table is thus obtained (as shown in FIG. 8).

The table tennis unit can also be employed in the stored position of the table by sliding the cover along one-half its length and engaging the hooks 52 within the staples 51 (shown in FIG. 6) in order to obtain the arrangement of FIG. 9.

The net 36 is then automatically placed in the upright position by means of the spring 37, the resilient net-holding strips 38 being drawn back to each side by stretching the elastic ties 41 until the position of engagement of the stops 42 is reached in order to apply tension to the net.

While a game of table tennis is in progress, a simple downward pressure exerted on the table-top panel 16*a* can tilt this latter downwards under the action of the springs 27. Any ping-pong balls which may come to rest at the center of the table can thus be easily retrieved. This feature is maintained in the arrangement of FIG. 9 by virtue of the springs of the hooks 52.

At the end of a game, the stops 42 are withdrawn as explained earlier in order to permit inward return of the strips 38. The table-top panel 16*a* is then folded-back against the panel 16*b* without any need to devote attention to the net which is imprisoned between the two table-top panels.

Referring to FIG. 11, an alternative mode of assembly of the table-tennis net will now be described.

In this embodiment, the table-top panels 116*a* and 116*b* which form a cover are pivotally coupled by means of a hinge 120, a plate 134 being engaged on the hinge-pin at each end. Springs 161, 162 fixed on the panels 116*a*, 116*b* maintain the plate 134 in the vertical position when the cover is opened-out.

An arm 163 is pivotally mounted on the plate 134 and one upper end of the net 136 is attached to the free end of said arm.

Cables 164, 165 are attached at a point 166 of the arm 163 and respectively at points 167 and 168 of the table-top panels 116*a* and 116*b*.

When the table cover is opened-out, the cables 164 and 165 draw the arm 163 away from the table in the outward direction, thus stretching the net 136 which is provided with an elastic top band.

When the cover is folded-back, the cables are slackened and allow the arm 163 to return inwards under the elastic action of the net.

It will be readily apparent that the invention is not limited to the example hereinabove described and that a number of different alternative embodiments could be contemplated without thereby departing from the scope of the invention. Thus the bottom roller track 6 could be dispensed with in order to retain only the top roller track 7. In that case the notch 14 would be formed in a special member and the ramp 15 would be stationary.

What is claimed is:

1. A convertible table primarily intended for games, comprising a stationary horizontal bottom panel mounted on four rigid legs and provided with two side panels and one end panel fixed to said bottom panel and extending upwardly, and a movable panel slidably mounted over said stationary panel for displacement in a direction parallel to said stationary panel by means of rollers adapted to cooperate with at least one pair of roller tracks secured to said side panels, the movable panel being capable of displacement from an inward storage position in which the movable panel overlies the stationary panel to an outwardly extended position in the line of extension of the stationary bottom panel and provided with at least one leg fitted with a small wheel for supporting said movable panel in said outwardly extended position, said roller tracks being placed with respect to said stationary bottom panel at a level such that the two panels are located in the storage position at a vertical distance from each other which permits storage of objects on said stationary bottom panel and said movable panel, said table further comprising a cover resting on said side panels for providing protection above said movable panel when said movable panel is in said storage position, said cover comprising two table-top panels joined to each other by means of a transverse hinge adjacent to that side of the table from which the movable panel is outwardly extensible, removable spacer members being provided for extending said at least one leg of the movable panel and receiving the unfolded table-top panel when said movable panel is in the outwardly extended position.

2. A table according to claim 1, wherein said cover being capable of pipoting and longitudinal sliding motion and provided in the central portion thereof with at least one hook for fastening said cover on when said cover is pivoted to an end-panel open position.

3. A table according to claim 1, wherein said at least one leg of the movable panel is fitted with springs for receiving the spacer members.

4. A table according to claim 1, wherein said table comprises a second pair of roller tracks located below said at least one pair of roller tracks for storing said movable panel close to said stationary panel, movable ramps being provided for selectively engaging the rollers of the movable panel on either of the two said pairs of roller tracks.

5. A table according to claim 1, wherein the hinge has a hinge pin adapted to carry in the vicinity of each end portion thereof an articulated plate fitted with means for fixing a table tennis net, springs attached to the table being provided for maintaining said plates in an upright position when the two table-top panels forming the cover are opened out horizontally.

6. A table according to claim 5, wherein a resilient L-shaped strip is slidably mounted within each articulated plate in order to secure the ends of a net, said resilient strips being so arranged as to project outwards from the table.

7. A table according to claim 6, wherein the resilient strips are connected together by elastic means which tend to draw said strips towards each other and are maintained by means of retractable shouldered portions applied against the articulated plates.

8. A table according to claim 5, wherein each plate is adapted to carry a lever pivotally mounted on said plate, the free end of said lever being intended to project outwards from the table and to carry an upper end of a net, said lever being connected by means of two cables to two points of attachment arranged respectively on the table and symmetrically with respect to the hinge.

9. A table according to claim 1, wherein said at least one leg of the movable panel is telescopic and is fitted with a spring which tends to cause extension thereof.

10. A table according to claim 9, wherein said movable panel comprises a system for locking said at least one leg in a position corresponding to a predetermined length.

11. A table according to claim 10, wherein the side panels each carry two roller guide rails located above said roller tracks and adapted to cooperate with the rollers of the movable panel in order to ensure that the movement of inward engagement of the movable panel has the effect of upwardly applying said rollers onto said guide rails for lifting said movable panel, and that the table rests to a partial extent on said at least one leg when said movable panel is in said inward position.

* * * * *